United States Patent [19]

Kaizer et al.

[11] 4,379,952

[45] Apr. 12, 1983

[54] MECHANICAL FILTER FOR AN ELECTRODYNAMIC TRANSDUCER

[75] Inventors: Adrianus J. M. Kaizer; Wiert Kopinga, both of Eindhoven, Netherlands

[73] Assignee: U.S. Philips Corporation, New York, N.Y.

[21] Appl. No.: 209,772

[22] Filed: Nov. 24, 1980

[30] Foreign Application Priority Data

Dec. 11, 1979 [NL] Netherlands ..... 7908896

[51] Int. Cl.[3] ..... H04R 7/00

[52] U.S. Cl. ..... 179/115.5 PC; 179/115.5 VC; 181/161

[58] Field of Search ..... 179/115.5 R, 115.5 ES, 179/115.5 PC, 115.5 VC; 181/165, 161, 166, 172

[56] References Cited

U.S. PATENT DOCUMENTS

| | | | |
|---|---|---|---|
| 2,007,750 | 7/1935 | Carlisle | 181/165 X |
| 2,071,829 | 2/1937 | Glen | 181/166 |
| 2,549,963 | 4/1951 | Boer et al. | 179/115.5 R |
| 2,551,447 | 5/1951 | Marquis | 179/115.5 R |
| 3,482,062 | 12/1969 | Hecht | 179/115.5 R |
| 3,516,151 | 6/1970 | Schneider | 179/115.5 VC |
| 3,603,427 | 9/1971 | Sotome | 181/166 |
| 4,283,606 | 8/1981 | Buck | 181/166 |

FOREIGN PATENT DOCUMENTS

| | | | |
|---|---|---|---|
| 571801 | 7/1931 | Fed. Rep. of Germany | 179/115.5 |

*Primary Examiner*—G. Z. Rubinson
*Assistant Examiner*—L. C. Schroeder
*Attorney, Agent, or Firm*—Robert T. Mayer; Bernard Franzblau

[57] ABSTRACT

An electrodynamic transducer having a mechanical filter as a coupling element between a voice coil former (3) and cone (1) in order to obtain a frequency characteristic whose high frequency roll-off begins at a lower frequency, in which a part (7) of the centering diaphragm (4) situated within the periphery of the voice coil former is used as the mechanical filter.

7 Claims, 3 Drawing Figures

MECHANICAL FILTER FOR AN ELECTRODYNAMIC TRANSDUCER

Figure 1:
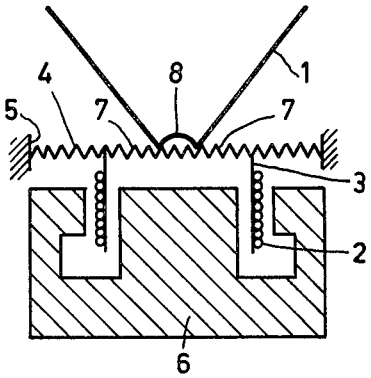

The invention relates to an electrodynamic transducer comprising a cone, a voice coil former on which a voice coil is arranged, and a coupling element between the voice coil former and the cone, which element functions as a mechanical filter.

An electrodynamic transducer of the aforementioned type is known from U.S. Pat. No. 2,007,750. In the transducer revealed in this patent the driving force is transferred from the voice coil former to the cone via the mechanical filter, which exhibits a low-pass characteristic, so that the high-frequency roll-off of the frequency characteristic of the transducer can be obtained earlier, that is at lower frequencies.

One of the examples described in said Patent is a mechanical filter which comprises a connecting ring made of a resilient material. A drawback of the use of such a ring as a mechanical filter is that, because during operation of a transducer of the afore-mentioned type the temperature of the voice coil and voice coil former may become very high, the properties of these mechanical filters may be changed irreversibly in such a way that they no longer have the desired effect. Furthermore, the disclosed construction has the drawback that during manufacture of said transducer an additional step is required in order to mount the resilient ring.

It is an object of the invention to provide a transducer equipped with a mechanical filter which can withstand the high temperatures of the voice coil former and which is moreover simpler to manufacture.

To this end the electrodynamic transducer according to the invention is characterized in that the transducer is provided with a centering diaphragm which extends across the voice coil former and that the cone is secured to a portion of the centering diaphragm which is situated within the periphery of the voice coil former, and the mechanical filter is constituted by the portion of the centering diaphragm which constitutes the connection (i.e. coupling element) between the voice coil former and the cone.

The invention is based on the recognition that by making the centering diaphragm extend across the voice coil former a portion of this centering diaphragm may be used for realizing the mechanical filter between the voice coil former and the cone. As the centering diaphragm itself is necessarily made of a material which can withstand the high temperatures of the voice coil former, the mechanical filter in the transducer in accordance with the invention can automatically withstand these temperatures. Moreover, this yields the advantage that a mechanical filter is obtained without the use of an additional production step during manufacture. In order to obtain specific properties of the mechanical filter it is possible to adapt the centering diaphragm, in particular its mechanical properties, by impregnating the diaphragm with an elastic material.

It is to be noted that Swiss Patent Specification No. 396,099, in particular FIG. 5, reveals a transducer in which the cone is secured to that portion of the centering diaphragm which projects from the voice coil former. The object of this construction is to obtain diaphragm sections which each operate in a specific portion of the acoustic spectrum to be reproduced.

However, a construction in which the diaphragm section for reproducing the bass tones is secured to that portion of the centering diaphragm which is situated within the periphery of the voice coil former is then not possible. Moreover, the transducer known from the Swiss Patent Specification has the drawback that in the low-frequency range the transmission from the voice coil former to the cone via the centering diaphragm portion between them is based on the leverage principle.

For the low frequency range this is a great disadvantage because the cone deflections are then large. In order to obtain a cone deflection in the transducer in accordance with the Swiss Patent which is equal to that in a normal transducer in which the cone is secured directly to the voice coil former, the deflection amplitude of the voice coil in said Swiss transducer must be larger owing to the said lever action. For this purpose special magnet systems must be used so that currently manufactured transducer types cannot readily be provided with the construction of said Swiss transducer, unless a reduced sensitivity is accepted. Furthermore, the larger voice coil deflection results in a higher distortion.

The electrodynamic transducer in accordance with the invention does not exhibit said lever action. Thus, the idea of a centering diaphragm which extends across the voice coil former and the use of a portion of the part of the centering diaphragm which is situated within the periphery of the voice coil former as a mechanical filter may directly be applied to all currently manufactured transducers without the need for special magnet systems.

A first embodiment of the electrodynamic transducer in accordance with the invention is characterized in that the cone is secured at its apex to the centering diaphragm.

Many known transducers, including the transducer in accordance with the Swiss Patent, exhibit an additional high-frequency sound peak owing to sound radiated by the dust cap or the portion of the centering diaphragm situated within the cone. This is a drawback because it is the very object of the invention to provide a transducer whose high-frequency roll-off in the frequency characteristic starts earlier, that is at lower frequencies.

In the first embodiment the transducer need not be provided with a dust cap and consequently does not exhibit the high-frequency peak in the sound spectrum. During manufacture this moreover has the advantage that the cone need only be glued to the centering diaphragm at one point, which is simpler than having to glue the cone to the centering diaphragm along a complete periphery without the glue flowing out.

A second embodiment of the electrodynamic transducer in accordance with the invention is characterized in that the part of the centering diaphragm which is situated within the periphery of the voice coil former is impermeable to air and the magnet core of the magnet system is formed with a duct which extends substantially coaxial with the cone. The duct functions as an acoustic resistance so that, depending on the size and the shape of the duct, the frequency characteristic of the transducer in accordance with the invention can be influenced as desired.

A third embodiment of the transducer in accordance with the invention is characterized in that the voice coil former is provided with means to restrain the voice coil former from tilting. Since the voice coil former is connected to the cone via the mechanical filter, it can tend to tilt. In that case it is not unlikely that the voice coil rubs in the air gap of the magnet system. By providing the voice coil former with means which reduce tilting of this coil former in accordance with said preferred embodiment, a transducer is obtained which produces an acoustic signal with low distortion and which has a long operating life.

A preferred embodiment of the electroacoustic transducer in accordance with the invention is characterized in that for this purpose at least a second centering diaphragm is secured to the voice coil former. By providing the voice coil former with a second centering diaphragm at another location the advantage of an increased resistance to tilting is obtained.

Figure 2:
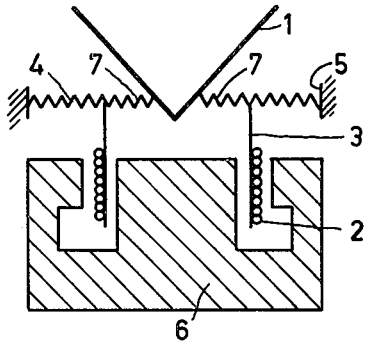
Figure 3:
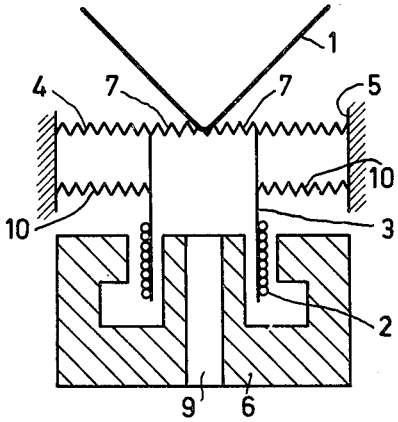

The invention will now be described in more detail with reference to the accompanying drawing in which:

FIG. 1 shows a first embodiment of the transducer in accordance with the invention, FIG. 2 shows a second embodiment of the transducer in accordance with the invention, and FIG. 3 shows a preferred embodiment of the transducer in accordance with the invention, the cone being secured to the centering diaphragm solely at its apex and the magnet system being formed with a duct.

The transducer of FIG. 1 comprises a vibratory cone 1, a voice coil former 3 on which a voice coil 2 is arranged, a centering diaphragm 4 and a magnet system 6. The centering diaphragm 4 is secured to a chassis 5 of the transducer and extends across the voice coil former. Within the periphery of the voice coil former, the cone is connected to the centering diaphragm along a circular rim and may be provided with a dust cap 8. The dust cap 8 serves to ensure that, if the centering ring is permeable to air, the front and rear of the cone are acoustically sealed with respect to each other. The mechanical filter is constituted by the annular portion 7 of the centering diaphragm between the connections of the voice coil former 3 and the cone 1 to the centering diaphragm 4.

The forces to which the voice-coil former is subjected by cooperation between the signal current through the voice coil and the magnetic field in the air gap of the magnet system are transmitted to the cone 1 via the mechanical filter formed by the annular portion 7, so said cone begins to vibrate. As the part of the centering diaphragm 4 which is situated within the periphery of the voice coil former is driven by the voice coil former 3 over its full circumference, it will be evident that no lever action occurs, so a high acoustic efficiency is obtained.

FIG. 2 shows a second embodiment of the transducer in accordance with the invention, the cone extending through the centering ring and terminating in a point at its apex. Since the cone is obviously impermeable to air the transducer need not be provided with a dust cap in this case, which yields a simplified construction. Moreover, this has the advantage that the high frequency peak in the spectrum of the transducer of FIG. 1, as a result of sound radiation by the dust cap 8 or the part of the centering diaphragm situated within the cone, is now reduced.

Finally, FIG. 3 represents a preferred embodiment of the transducer in accordance with the invention, in which the cone 1 is secured at its apex to the part of the centering diaphragm 4 situated within the periphery of the voice coil former 3. Now the cone need not be secured along a periphery but solely at one point, for example by means of glue. This means a simplified and thus more rapid mounting during manufacture. An additional advantage is obtained if the centering diaphragm is made air-tight and the magnet core is formed with a duct 9. This duct 9 functions as an acoustic resistance in conjunction with the annular portion 7 of the centering diaphragm within the periphery of the voice coil former 3. Depending on the size and the shape of the duct 9 the frequency response of the transducer can be influenced.

Since the voice coil former now no longer has a rigid connection with the cone, it has a low resistance to tilting. As a result of this the voice coil may become off-centred in the air gap of the magnet system 6. In order to avoid this, the voice coil former 3 may be provided with means, in known manner, in order to obtain an additional resistance to tilting. For this purpose the voice coil former in the embodiment of FIG. 3 is provided with a second centering diaphragm 10.

The invention is by no means limited to the embodiments shown in the Figures, but is equally applicable to transducers of different shape or transducers in which the centering diaphragm does not completely seal the voice coil former.

We claim:

1. An electrodynamic transducer comprising a vibratory cone, a voice coil former on which a voice coil is arranged, and a coupling element between the voice coil former and the cone comprising a centering diaphragm which extends across the voice coil former with the cone secured to a portion of the centering diaphragm which is situated within the periphery of the voice coil former and the portion of the centering diaphragm which constitutes the coupling element between the voice coil former and the cone being operative to function as a mechanical filter.

2. An electrodynamic transducer as claimed in claim 1, characterized in that the cone is secured at its apex to the centering diaphragm.

3. An electrodynamic transducer as claimed in claim 1 or 2, characterized in that the part of the centering diaphragm which is situated within the periphery of the voice coil former is impermeable to air and the magnet core of the magnet system is formed with a duct which extends substantially coaxial with the cone.

4. An electrodynamic transducer as claimed in claim 1 or 2, characterized in that the voice coil former is provided with means for restraining the voice coil former from tilting.

5. An electrodynamic transducer as claimed in claim 4 wherein said restraining means includes a second centering diaphragm secured to the voice coil former.

6. An electrodynamic transducer as claimed in claim 3 further comprising means coupled to the voice coil former for restraining the coil former from tilting.

7. An electrodynamic transducer as claimed in claim 6 wherein said restraining means includes a second centering diaphragm secured to the voice coil former and axially displaced from the first centering diaphragm.

* * * * *